US008115728B2

(12) United States Patent
Feng

(10) Patent No.: US 8,115,728 B2
(45) Date of Patent: Feb. 14, 2012

(54) IMAGE DISPLAY DEVICE WITH REDUCED FLICKERING AND BLUR

(75) Inventor: Xiao-fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 879 days.

(21) Appl. No.: 11/157,231

(22) Filed: Jun. 20, 2005

(65) Prior Publication Data

US 2006/0202945 A1 Sep. 14, 2006

Related U.S. Application Data

(60) Provisional application No. 60/660,008, filed on Mar. 9, 2005, provisional application No. 60/685,238, filed on May 26, 2005.

(51) Int. Cl.
*G09G 3/36* (2006.01)

(52) U.S. Cl. ..... 345/102; 345/87; 349/62

(58) Field of Classification Search ..... 345/87, 345/102; 349/62

See application file for complete search history.

(56) References Cited

U.S. PATENT DOCUMENTS

| | | | | |
|---|---|---|---|---|
| 5,471,225 | A | 11/1995 | Parks | |
| 5,844,534 | A * | 12/1998 | Okumura et al. | 345/90 |
| 5,844,540 | A * | 12/1998 | Terasaki | 345/102 |
| 2001/0024199 | A1 | 9/2001 | Hughes | |
| 2001/0033260 | A1 * | 10/2001 | Nishitani et al. | 345/87 |
| 2002/0003522 | A1 * | 1/2002 | Baba et al. | 345/89 |
| 2002/0008694 | A1 | 1/2002 | Miyachi et al. | |
| 2002/0057238 | A1 | 5/2002 | Nitta et al. | |
| 2002/0149574 | A1 | 10/2002 | Johnson | |
| 2002/0154088 | A1 | 10/2002 | Nishimura | |
| 2002/0175907 | A1 | 11/2002 | Sekiya | |
| 2003/0010894 | A1 * | 1/2003 | Yoshihara et al. | 250/208.1 |
| 2003/0146897 | A1 | 8/2003 | Hunter | |
| 2003/0156092 | A1 * | 8/2003 | Suzuki et al. | 345/98 |
| 2003/0169247 | A1 | 9/2003 | Kawabe | |
| 2004/0012551 | A1 | 1/2004 | Ishii | |
| 2004/0066363 | A1 * | 4/2004 | Yamano et al. | 345/98 |
| 2005/0184952 | A1 * | 8/2005 | Konno et al. | 345/102 |
| 2005/0285815 | A1 * | 12/2005 | Tryhub et al. | 345/58 |
| 2010/0020002 | A1 | 1/2010 | Van Woudenberg et al. | |

FOREIGN PATENT DOCUMENTS

| | | | |
|---|---|---|---|
| EP | 1 255 241 | | 11/2002 |
| JP | 01010299 | | 1/1989 |
| JP | 2001-108962 | A | 4/2001 |
| JP | 2001-125067 | | 5/2001 |
| JP | 2002-287700 | A | 4/2002 |
| JP | 2003-241721 | | 8/2003 |
| JP | 2004-020738 | | 1/2004 |
| JP | 2004-309592 | A | 4/2004 |
| JP | 2005-107531 | | 4/2005 |
| JP | 2005-326614 | | 11/2005 |
| JP | 2008-525839 | A | 7/2008 |
| WO | WO 2004013835 | | 2/2004 |
| WO | WO 2006/070323 | | 7/2006 |

OTHER PUBLICATIONS

International Search Report and Written Opinion of the International Searching Authority for PCT/JP2007/064297 filed Jul. 12, 2007, 7 pages.

Partial European Search Report for Application No. EP 06 00 4741 dated Oct. 10, 2008, Place of search—Munich, 5 pages.

Extended European Search Report issued on Jan. 26, 2009 with respect to EP Application No. 06004741.2 by the Japanese Patent Office, 14 pages.

Japanese Office Action dated Mar. 1, 2011, Japanese App. No. 2006-056636, based on U.S. Appl. No. 11/157,231 of Sharp Kabushiki Kaisha, 2 pgs.

* cited by examiner

*Primary Examiner* — Amare Mengistu
*Assistant Examiner* — Vinh Lam
(74) *Attorney, Agent, or Firm* — Chernoff Vilhauer McClung & Stenzel LLP

(57) ABSTRACT

A backlit display with improved display characteristics.

19 Claims, 10 Drawing Sheets

LCD system configuration

Flashing backlight scheme to reduce the motion blur

Ghosting image from double flashing

Temporal dithering with a cluster screen

Temporal dithering with a dispersed screen

Switching from cluster to disperse

Switching from cluster to disperse with 3 transition frames

Conversion from HDR image to backlight and LCD modulator

Ghosting due to synchronization of LCD driving and backlight flashing

Dither screen shifted to synchronize with the LCD driving

IMAGE DISPLAY DEVICE WITH REDUCED FLICKERING AND BLUR

CROSS REFERENCE TO RELATED DOCUMENTS

The present application claims the benefit of U.S. Provisional App. No. 60/660,008, filed Mar. 9, 2005 and U.S. Provisional App. No. 60/685,238, filed May 26, 2005.

BACKGROUND OF THE INVENTION

The present invention relates to backlit displays and, more particularly, to a backlit display with improved performance characteristics.

The local transmittance of a liquid crystal display (LCD) panel or a liquid crystal on silicon (LCOS) display can be varied to modulate the intensity of light passing from a backlit source through an area of the panel to produce a pixel that can be displayed at a variable intensity. Whether light from the source passes through the panel to an viewer or is blocked is determined by the orientations of molecules of liquid crystals in a light valve.

Since liquid crystals do not emit light, a visible display requires an external light source. Small and inexpensive LCD panels often rely on light that is reflected back toward the viewer after passing through the panel. Since the panel is not completely transparent, a substantial part of the light is absorbed during its transits of the panel and images displayed on this type of panel may be difficult to see except under the best lighting conditions. On the other hand, LCD panels used for computer displays and video screens are typically backlit with fluorescent tubes or arrays of light-emitting diodes (LEDs) that are built into the sides or back of the panel. To provide a display with a more uniform light level, light from these points or line sources is typically dispersed in a diffuser panel before impinging on the light valve that controls transmission to a viewer.

The transmittance of the light valve is controlled by a layer of liquid crystals interposed between a pair of polarizers. Light from the source impinging on the first polarizer comprises electromagnetic waves vibrating in a plurality of planes. Only that portion of the light vibrating in the plane of the optical axis of a polarizer can pass through the polarizer. In an LCD the optical axes of the first and second polarizers are arranged at an angle so that light passing through the first polarizer would normally be blocked from passing through the second polarizer in the series. However, a layer of translucent liquid crystals occupies a cell gap separating the two polarizers. The physical orientation of the molecules of liquid polarizers are arranged at an angle so that light passing through the first polarizer would normally be blocked from passing through the second polarizer in the series. However, a layer of translucent liquid crystals occupies a cell gap separating the two polarizers. The physical orientation of the molecules of liquid crystal can be controlled and the plane of vibration of light transiting the columns of molecules spanning the layer can be rotated to either align or not align with the optical axes of the polarizers. It is to be understood that normally white may likewise be used.

The surfaces of the first and second polarizers forming the walls of the cell gap are grooved so that the molecules of liquid crystal immediately adjacent to the cell gap walls will align with the grooves and, thereby, be aligned with the optical axis of the respective polarizer. Molecular forces cause adjacent liquid crystal molecules to attempt to align with their neighbors with the result that the orientation of the molecules in the column spanning the cell gap twist over the length of the column. Likewise, the plane of vibration of light transiting the column of molecules will be "twisted" from the optical axis of the first polarizer to that of the second polarizer. With the liquid crystals in this orientation, light from the source can pass through the series polarizers of the translucent panel assembly to produce a lighted area of the display surface when viewed from the front of the panel. It is to be understood that the grooves may be omitted in some configurations.

To darken a pixel and create an image, a voltage, typically controlled by a thin film transistor, is applied to an electrode in an array of electrodes deposited on one wall of the cell gap. The liquid crystal molecules adjacent to the electrode are attracted by the field created by the voltage and rotate to align with the field. As the molecules of liquid crystal are rotated by the electric field, the column of crystals is "untwisted,' and the optical axes of the crystals adjacent the cell wall are rotated out of alignment with the optical axis of the corresponding polarizer progressively reducing the local transmittance of the light valve and the intensity of the corresponding display pixel. Color LCD displays are created by varying the intensity of transmitted light for each of a plurality of primary color elements (typically, red, green, and blue) that make up a display pixel.

LCDs can produce bright, high resolution, color images and are thinner, lighter, and draw less power than cathode ray tubes (CRTs). As a result, LCD usage is pervasive for the displays of portable computers, digital clocks and watches, appliances, audio and video equipment, and other electronic devices. On the other hand, the use of LCDs in certain "high end markets, such as video and graphic arts, is frustrated, in part, by the limited performance of the display.

Baba et al., U.S. Patent Publication No. 2002/0003522 A1 describe a display for a liquid crystal display that includes a flashing period for the backlight of the display that is based upon the brightness level of the image. In order to reduce the blurring an estimation of the amount of motion of the video content is determined to change the flashing width of the backlight for the display. To increase the brightness of the display, the light source of the backlight may be lighted with lower brightness in the non-lightening period than in the lightening period. However, higher brightness images requires less non-lightening period and thus tends to suffer from a blurring effect for video content with motion. To reduce the blurring of the image Baba et al. uses a motion estimation, which is computationally complex, to determine if an image has sufficient motion. For images with sufficient motion the non-lightening period is increased so that the image blur is reduced. Unfortunately, this tends to result in a dimmer image.

What is desired, therefore, is a liquid crystal display having reduced blur.

DETAILED DESCRIPTION OF THE INVENTION

Figure 1A:
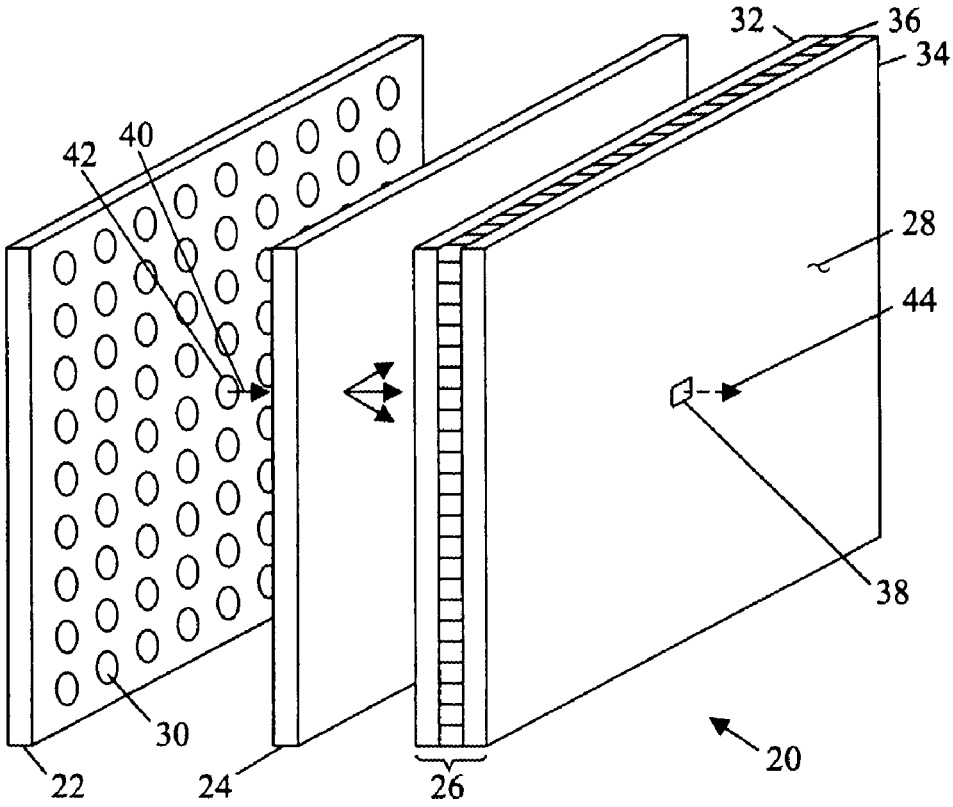
FIGS. 1A and 1B are schematic diagrams of liquid crystal displays (LCDs).
Figure 1B:
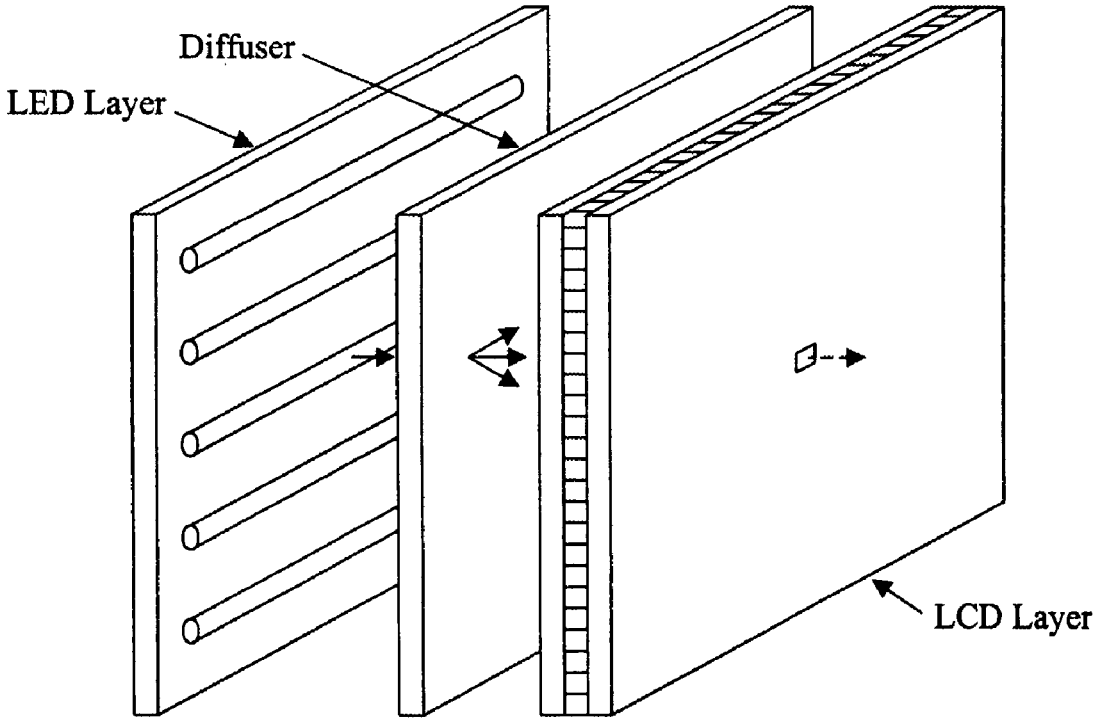

Referring to FIG. 1A, a backlit display 20 comprises, generally, a backlight 22, a diffuser 24, and a light valve 26 (indicated by a bracket) that controls the transmittance of light from the backlight 22 to a user viewing an image displayed at the front of the panel 28. The light valve, typically comprising a liquid crystal apparatus, is arranged to electronically control the transmittance of light for a picture element or pixel. Since liquid crystals do not emit light, an external source of light is necessary to create a visible image. The source of light for small and inexpensive LCDs, such as those used in digital clocks or calculators, may be light that is reflected from the back surface of the panel after passing through the panel. Likewise, liquid crystal on silicon (LCOS) devices rely on light reflected from a backplane of the light valve to illuminate a display pixel. However, LCDs absorb a significant portion of the light passing through the assembly and an artificial source of light such as the backlight 22 comprising fluorescent light tubes or an array of light sources 30 (e.g., light-emitting diodes (LEDs)), as illustrated in FIGS. 1A and 1B, are useful to produce pixels of sufficient intensity for highly visible images or to illuminate the display in poor lighting conditions. There may not be a light source 30 for each pixel of the display and, therefore, the light from the point or line sources is typically dispersed by a diffuser panel 24 so that the lighting of the front surface of the panel 28 is more uniform.

Light radiating from the light sources 30 of the backlight 22 comprises electromagnetic waves vibrating in random planes. Only those light waves vibrating in the plane of a polarizer's optical axis can pass through the polarizer. The light valve 26 includes a first polarizer 32 and a second polarizer 34 having optical axes arrayed at an angle so that normally light cannot pass through the series of polarizers. Images are displayable with an LCD because local regions of a liquid crystal layer 36 interposed between the first 32 and second 34 polarizer can be electrically controlled to alter the alignment of the plane of vibration of light relative of the optical axis of a polarizer and, thereby, modulate the transmittance of local regions of the panel corresponding to individual pixels 36 in an array of display pixels.

The layer of liquid crystal molecules 36 occupies a cell gap having walls formed by surfaces of the first 32 and second 34 polarizers. The walls of the cell gap are rubbed to create microscopic grooves aligned with the optical axis of the corresponding polarizer. The grooves cause the layer of liquid crystal molecules adjacent to the walls of the cell gap to align with the optical axis of the associated polarizer. As a result of molecular forces, each succeeding molecule in the column of molecules spanning the cell gap will attempt to align with its neighbors. The result is a layer of liquid crystals comprising innumerable twisted columns of liquid crystal molecules that bridge the cell gap. As light 40 originating at a light source element 42 and passing through the first polarizer 32 passes through each translucent molecule of a column of liquid crystals, its plane of vibration is twisted so that when the light reaches the far side of the cell gap its plane of vibration will be aligned with the optical axis of the second polarizer 34. The light 44 vibrating in the plane of the optical axis of the second polarizer 34 can pass through the second polarizer to produce a lighted pixel 38 at the front surface of the display 28.

To darken the pixel 38, a voltage is applied to a spatially corresponding electrode of a rectangular array of transparent electrodes deposited on a wall of the cell gap. The resulting electric field causes molecules of the liquid crystal adjacent to the electrode to rotate toward alignment with the field. The effect is to untwist the column of molecules so that the plane of vibration of the light is progressively rotated away from the optical axis of the polarizer as the field strength increases and the local transmittance of the light valve 26 is reduced. As the transmittance of the light valve 26 is reduced, the pixel 28 progressively darkens until the maximum extinction of light 40 from the light source 42 is obtained. Color LCD displays are created by varying the intensity of transmitted light for each of a plurality of primary color elements (typically, red, green, and blue) elements making up a display pixel. Other arrangements of structures may likewise be used.

The LCD uses transistors as a select switch for each pixel, and adopts a display method (hereinafter, called as a "hold-type display"), in which a displayed image is held for a frame period. In contrast, a CRT (hereinafter, called as an "impulse-type display") includes selected pixel that are darkened immediately after the selection of the pixel. The black is displayed between each frame of the motion image rewritten in 60 Hz in case of the impulse-type display like the CRT. That is, the black is displayed excluding a period when the image is displayed, and one frame of the motion image is presented respectively to the viewer as an independent image. Therefore, the image is observed as a clear motion image in the impulse-type display Thus, the LCD is fundamentally different from CRT in time axis hold characteristic in an image display. Therefore, when the motion image is displayed on a LCD, image deterioration such as blurring the image is caused. The principal cause of this blurring effect arises from a viewer that follows the moving object of the motion image (when the eyeball movement of the viewer is a following motion), even if the image is rewritten, for example, at 60 Hz discrete steps. The eyeball has a characteristic to attempt to smoothly follow the moving object even though it is discretely presented in a "hold type" manner.

However, in the hold-type display, the displayed image of one frame of the motion image is held for one frame period, and is presented to the viewer during the corresponding period as a still image. Therefore, even though the eyeball of the viewer smoothly follows the moving object, the displayed image stands still for one frame period. Therefore, the shifted image is presented according to the speed of the moving object on the retina of the viewer. Accordingly, the image will appear blurred to the viewer due to integration by the eye. In addition, since the change between the images presented on the retina of the viewer increases with greater speed, such images become even more blurred.

Figure 2:
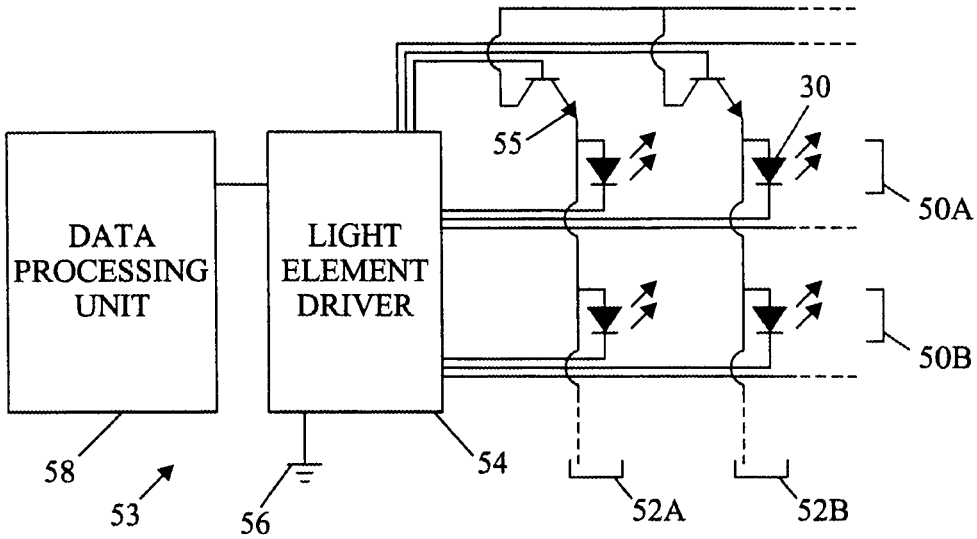
FIG. 2 is a schematic diagram of a driver for modulating the illumination of a plurality of light source elements of a backlight.

In the backlit display 20 the backlight 22 comprises an array of locally controllable light sources 30. The individual light sources 30 of the backlight may be light-emitting diodes (LEDs), an arrangement of phosphors and lensets, or other suitable light-emitting devices. In addition, the backlight may include a set of independently controllable light sources, such one or more cold cathode ray tubes. The light-emitting diodes may be 'white' and/or separate colored light emitting diodes. The individual light sources 30 of the backlight array 22 are independently controllable to output light at a luminance level independent of the luminance level of light output by the other light sources so that a light source can be modulated in response to any suitable signal. Similarly, a film or material may be overlaid on the backlight to achieve the spatial and/or temporal light modulation. Referring to FIG. 2, the light sources 30 (LEDs illustrated) of the array 22 are typically arranged in the rows, for examples, rows 50*a* and 50*b*, (indicated by brackets) and columns, for examples, columns 52*a* and 52*b* (indicated by brackets) of a rectangular array. The output of the light sources 30 of the backlight are controlled by a backlight driver 53. The light sources 30 are driven by a light source driver 54 that powers the elements by selecting a column of elements 52*a* or 52*b* by actuating a column selection transistor 55 and connecting a selected light source 30 of the selected column to ground 56. A data processing unit 58, processing the digital values for pixels of an image to be displayed, provides a signal to the light driver 54 to select the appropriate light source 30 corresponding to the displayed pixel and to drive the light source with a power level to produce an appropriate level of illumination of the light source.

Figure 3:
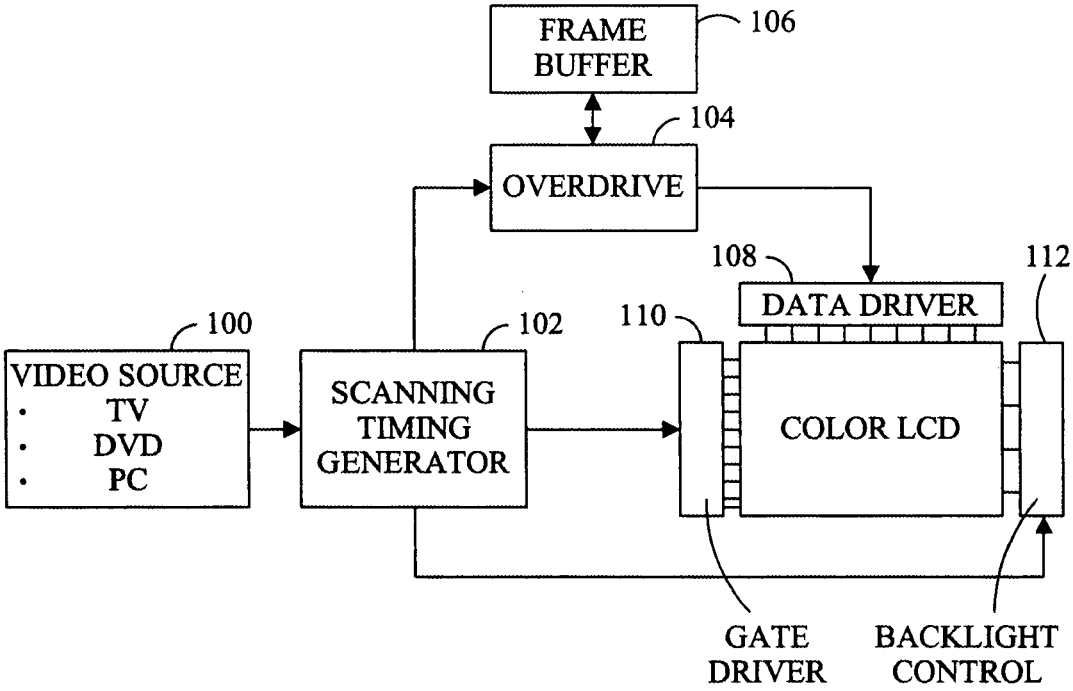
FIG. 3 illustrates a LCD system configuration.

FIG. 3 illustrates a block diagram of a typical data path within a liquid crystal panel. The video data 100 may be provided from any suitable source, such as for example, television broadcast, Internet connection, file server, digital video disc, computer, video on demand, or broadcast. The video data 100 is provided to a scanning and timing generator 102 where the video data is converted to a suitable format for presentation on the display. In many cases, each line of data is provided to an overdrive circuit 104, in combination with a frame buffer 106, to compensate for the slow temporal response of the display. The signal from the overdrive 104 is preferably converted to a voltage value in the data driver 108 which is output to individual data electrodes of the display. The generator 102 also provides a clock signal to the gate driver 110, thereby selecting one row at a time, which stores the voltage data on the data electrode on the storage capacitor of each pixel of the display. The generator 102 also provides backlight control signals 112 to control the level of luminance from the backlight, and/or the color or color balance of the light provided in the case of spatially non-uniform backlight (e.g., based upon image content and/or spatially different in different regions of the display).

Figure 4:
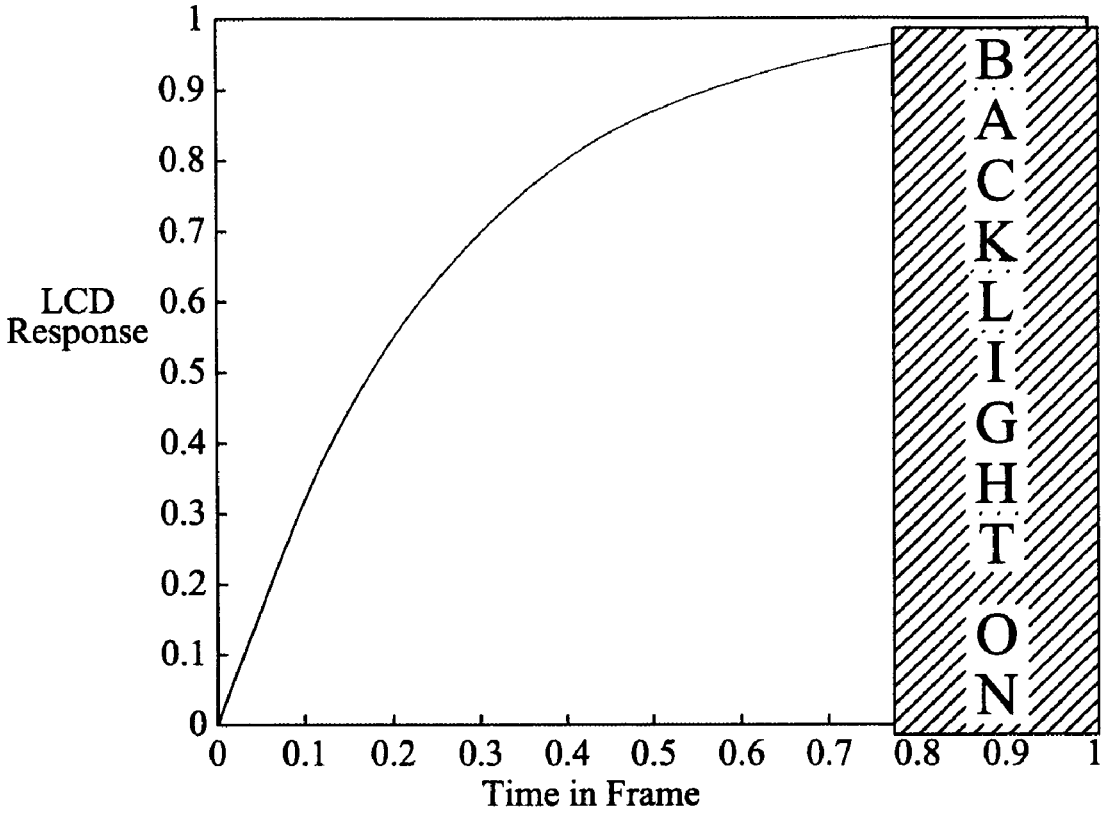
FIG. 4 illustrates a flashing backlight scheme.

The use of the overdrive circuit 104 tends to reduce the motion blur but the image blur effects of eye tracking the motion while the image is held stationary during the frame time still causes a relative motion on the retina which is perceived as motion blur. One technique to reduce the perceived motion blur is to reduce the time that an image frame is displayed. FIG. 4 illustrates the effect of flashing the backlight during only a portion of the frame. It is preferable that the flashing of the backlight is toward the end of the frame where the transmission of the liquid crystal material has reached or otherwise is approaching the target level. For example, the majority of the duration of the flashing backlight is preferably during the last third of the frame period. While modulating the backlight in some manner reduces the perceived motion blur, it unfortunately tends to result in a flickering artifact, due to the general 'impulse' nature of the resulting display technique. In order to reduce the flickering, the backlight may be flashed at a higher rate.

Figure 5:
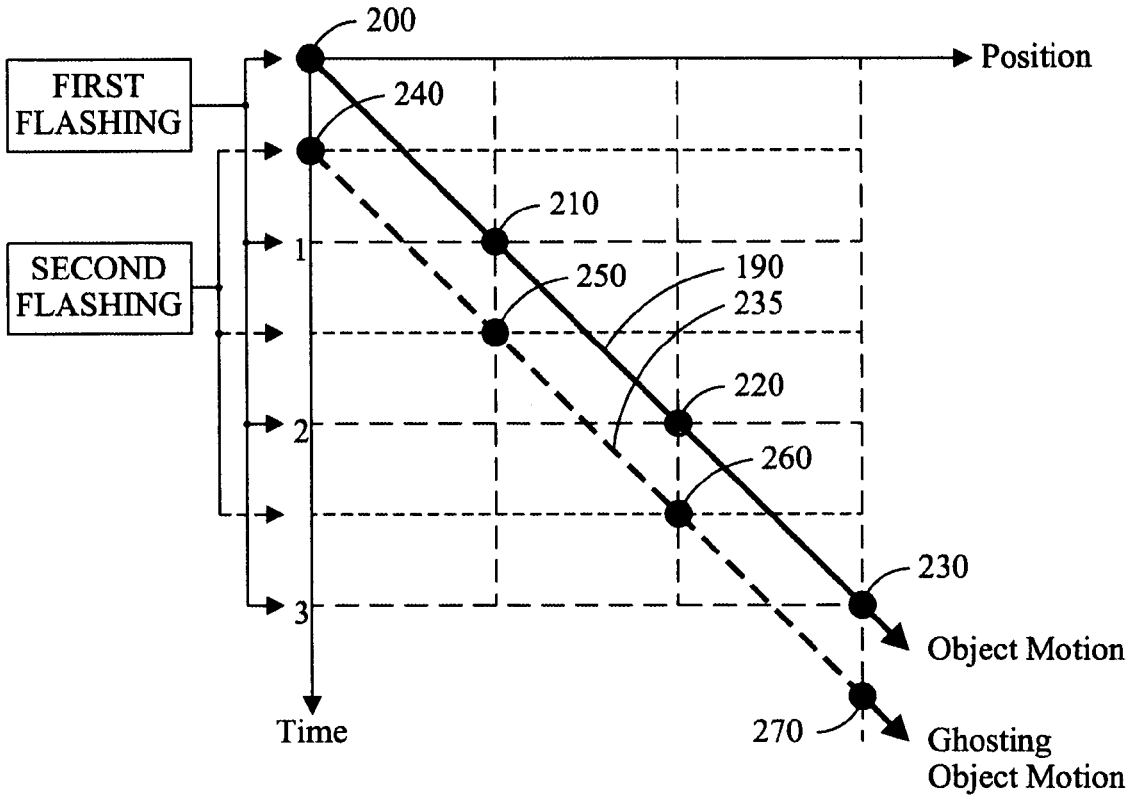
FIG. 5 illustrates image ghosting.

While flashing the backlight at a higher rate may seemingly be a complete solution, unfortunately, such higher rate flashing tends to result in "ghosted images". Referring to FIG. 5, a graph of the motion of a portion of an image across a display over time is illustrated. With the first flashing of a frame at the frame rate, as illustrated by the solid line 190, the image would appear to the user at each time interval (e.g., frame rate). In particular, the image would appear at position 200 at the end of the first frame, is shifted and would appear at position 210 at the end of the second frame, is shifted and would appear at position 220 at the end of the third frame, and is shifted and would appear at position 230 at the end of the fourth frame. Accordingly, the moving image would be 'flashed' to the viewer at four different times corresponding to four different positions.

When a second flash is included at the frame rate it may be centrally timed during the frame, and is illustrated by the dashed line 235. The image would appear to the user at each time interval central to the frame. In particular the image would appear at position 240 at the middle of the first frame, is shifted and would appear at position 250 at the middle of the second frame, is shifted and would appear at position 260 at the middle of the third frame, and is shifted and would appear at position 270 at the middle of the fourth frame. Accordingly, the moving image would be 'flashed' to the viewer at four additional different times corresponding to four different positions.

With the combination of the first flashing and the second flashing during each frame, the ghosting of the image results in relatively poor image quality with respect to motion. One technique to reduce the effect of blurring is to drive the liquid crystal display at the same rate as the backlight together with motion compensated frame interpolation. While a plausible solution, there is significant increased cost associated with the motion estimate and increased frame rate.

After considering the potential ghosting of images that would result from decreasing the flickering resulting from liquid crystal displays, it was determined that in fact the blurring of the image that results is generally localized to those regions of the display that include motion. The general regions of the display that do not include motion do not tend to blur the image since the image is generally stationary. To determine those regions of the display that are likely to experience blurring and those regions of the display that are not likely to experience blurring, the image may be divided into a set of regions, such as for example blocks. For example, the blocks may include a single or group of light emitting diodes, or one or more cold cathode fluorescent tubes. Also, the corresponding regions of the light valve may include one or a group of pixels. The backlight for each region is operated in a manner that is independent of other regions, or otherwise each of the regions may have a different luminance value or color (e.g., color temperature or set of colors). The luminance of the backlight in different regions is changed, such as from "on" to "off", or some level there between. A motion detection scheme may be used for each region to determine those in which sufficient motion exists, which are likely to exhibit blurring. The remaining regions may be classified as where insufficient motion exists, which are not likely to exhibit blurring. This is the same as the regions where insufficient motion exists may be determined and the remaining regions classified as where sufficient motion exists. In some manner, some regions likely to exhibit blurring and some regions not likely to exhibit blurring are identified.

After consideration, it was determined that those regions with sufficient motion are unlikely to be adversely affected by some flickering because the motion will mask the flickering. Similarly, those regions with insufficient motion are not going to be adversely affected by blurring since the image is substantially unchanged. Accordingly, the regions identified as including sufficient motion may be illuminated with a backlight technique in a first manner that preferably tends to reduce the blurring without significant regard for flickering. The regions identified as including insufficient motion are illuminated with a backlight technique that preferably tends to reduce the amount of flickering without significant regard for blurring. These seemingly contradictory concerns may be accomodated using spatially and/or temporally varying backlight modulation techniques.

Figure 6:
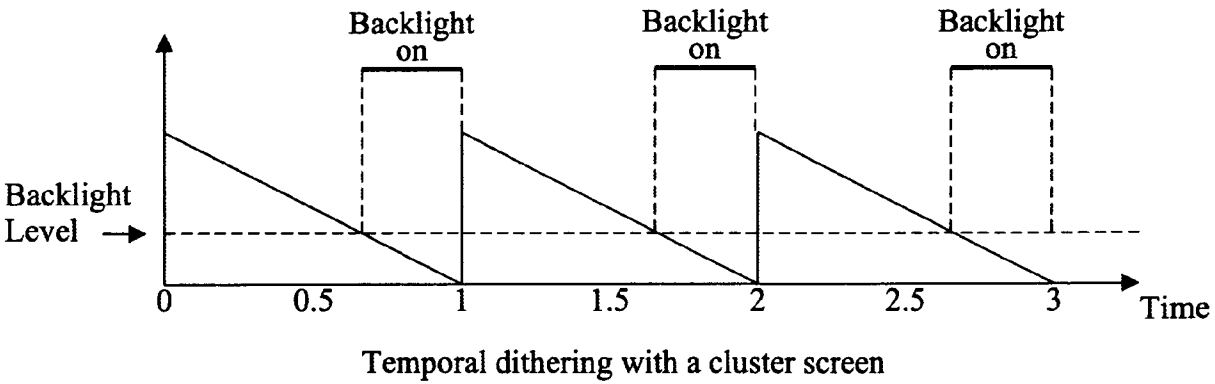
FIG. 6 illustrates temporal screen.

Referring to FIG. 6, one suitable technique for performing this backlight modulation for regions determined to have sufficient motion includes a function, generally referred to as a screen function, given by $[S_c(t)=A(1-t-\text{floor}(t))]$ $S_c(t)=A(1-t+\text{floor}(t))$, where t is time in frames, floor(t) is an operation that takes the integer portion of a floating point number and A is the screen amplitude, which determines the flashing duty cycle. A large A reduces the duty cycle which results in lower motion blur. The floor(t) may be a set level, may be based upon the content of the image, or otherwise may be adaptive. The desired backlight level is compared to the first screen function, and if the desired backlight level is greater than the screen function, the backlight is on as indicated with the thick solid lines. In this manner, the motion blur may be selected in relation to the desired backlight level. Other suitable techniques may likewise be used.

Figure 7:
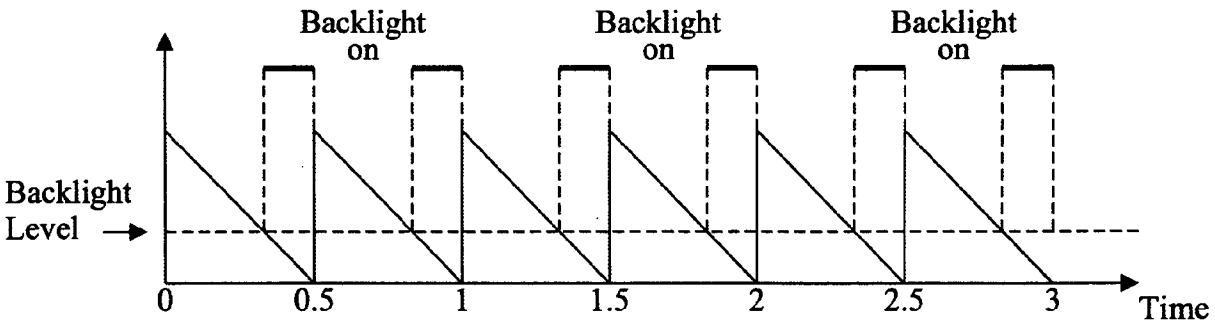
FIG. 7 illustrates another temporal screen.

Referring to FIG. 7, one suitable technique for performing this backlight modulation for regions determined to have insufficient motion includes a function generally referred to as a screen function, given by $[S_d=A(1-2t-\text{floor}(2t))]$ $S_d=A(1-2t+\text{floor}(2t))$, where t is time in frame, and A is the screen amplitude. The desired backlight level is compared to the screen function, and if the desired backlight level is greater than the screen function, the backlight is on as indicated with the thick solid lines. The backlight in FIG. 7 has a greater frequency than the backlight in FIG. 6, such as twice the frequency, and thus tends to reduce the perception of flickering. Other suitable techniques may likewise be used. Preferably, the area for the illuminated region of FIG. 6 and the illuminated region of FIG. 7 are substantially the same, within 10%, 25%, or 50%.

Figure 8:
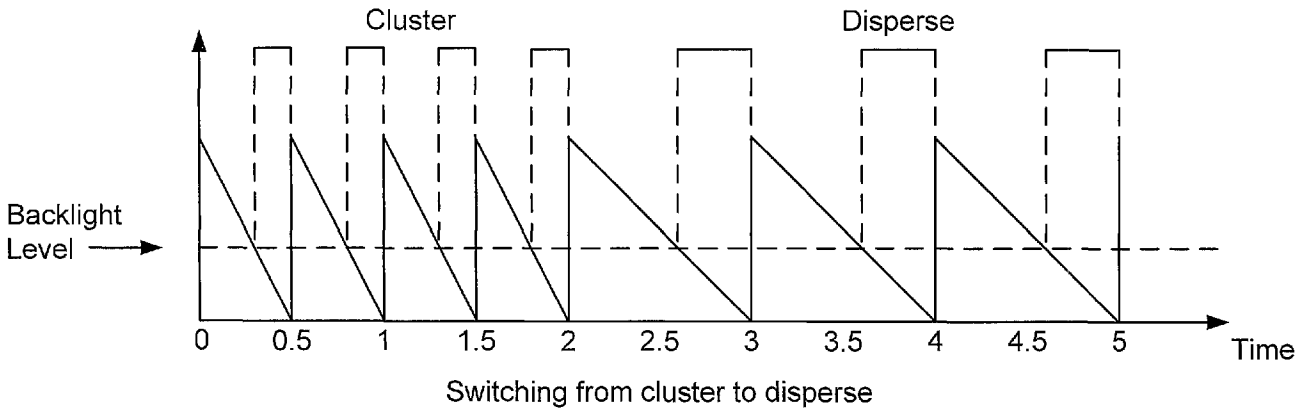
FIG. 8 illustrates switching from one temporal screen to another temporal screen.

While this technique is effective, it turns out that the boundary between a region with a first screen function and another screen function results in a temporal discontinuity as illustrated in FIG. 8. The first two frames have a backlight flashing at a rate of twice the frame rate, and then the following three frames have a backlight flashing at a rate equal to the frame rate. During the transition 250 between the second and third frames, the time 260 between backlight flashing increases. This transition 260 between different backlight flashing rates when combined with motion tends to result in an effect similar to flickering. To reduce this flickering effect the system should include a transition to smooth out the average temporal spacing between backlight flashing.

Referring to FIG. 8, one technique to provide a more gradual transition is to use three different transition frames between the first and second backlight flashing techniques. The transition frames may be characterized as follows:

$$S_t = \begin{cases} A\left(1 - \dfrac{t - \text{floor}(t)}{0.5\left(1 - \dfrac{i}{(N+1)}\right)}\right) & 0 \le = t - \text{floor}(t) < 0.5\left(1 - \dfrac{i}{N+1}\right) \\ A\left(1 - \dfrac{t - 0.5 - \text{floor}(t - 0.5)}{0.5\left(1 + \dfrac{i}{(N+1)}\right)}\right) & 0.5\left(1 - \dfrac{i}{N+1}\right) <= t - \text{floor}(t) < 1 \end{cases}$$

where N is the total number of transition frames, and I denotes the ith transition frame. The transition from cluster (first screen function) to disperse (second screen function) is the reverse of the transition from disperse (second screen function) to cluster (first screen function). As it may be observed, the effect to is reduce the abruptness of the transition between the disperse and cluster backlight flashing techniques.

The reduction in the abruptness of the change from the cluster to disperse screens may likewise be implemented using other techniques. For example, the frame may be subdivided into a temporal frame time including multiple subfields. A disperse screen is equivalent to turn on the subfields near t=0.5 and t=1.0, while a cluster screen can be approximated by turn on the subfields near t=1.0. The intensity ("on" width) of the backlight can be approximated with number of "on" subfields. The more "on" subfields, the higher the backlight output. The transition screen from disperse to cluster can be implemented by gradually moving the "on" subfields from t=0.5 toward t=1.0 until the two "on" regions merge into one cluster of "on" region. The transition from cluster to disperse can be implemented by splitting the "on" subfields near t=1.0 into two "on" regions, and gradually move the half toward the middle (t=0.5).

Figure 13:
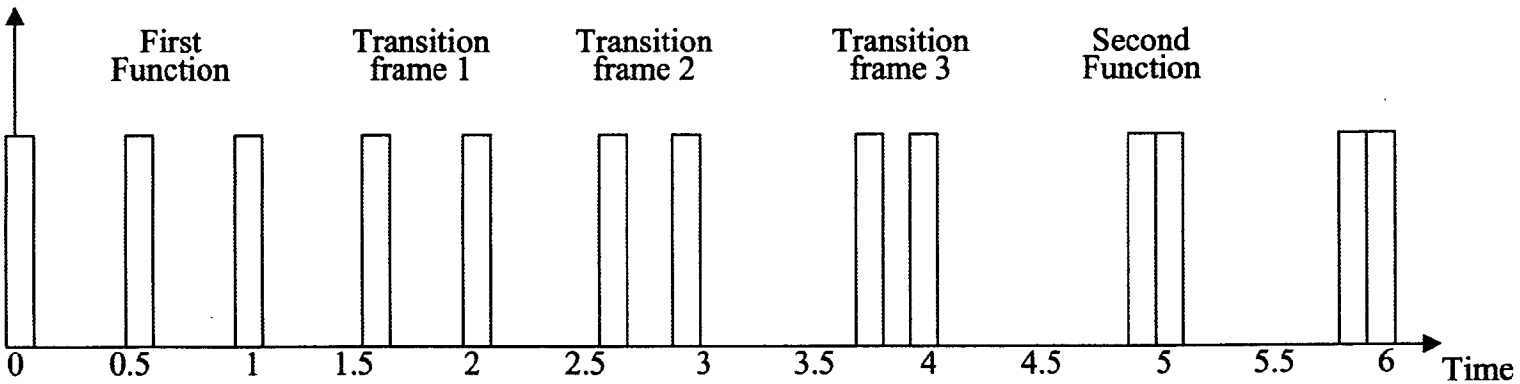
FIG. 13 illustrates another embodiment.

In the following discussion, simply for purposes of illustration the disperse screen is designated to be screen 0, first transition screen to be screen 1, last transition to be screen N (with total N transition screens), and cluster screen to be N+1, as illustrated in FIG. 13.

Figure 14:
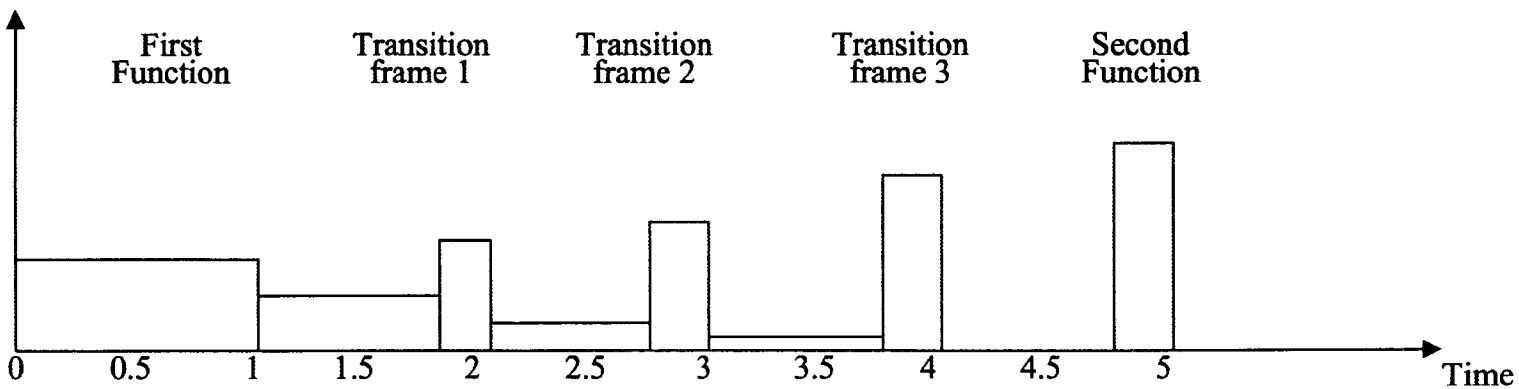
FIG. 14 illustrates yet another embodiment.

FIG. 14, illustrates another embodiment where the first function is a continuous "on" during the whole frame (or a majority of the frame) at one level, and the second function is a higher intensity level with shorter duration near the end of the frame. The transition frames are used to reduce the flickering effect due to transition from motion to non-motion, or from non-motion to motion. The intensity of the backlight is set such that the area in any frame is generally equal to the desired backlight level.

Figure 10:
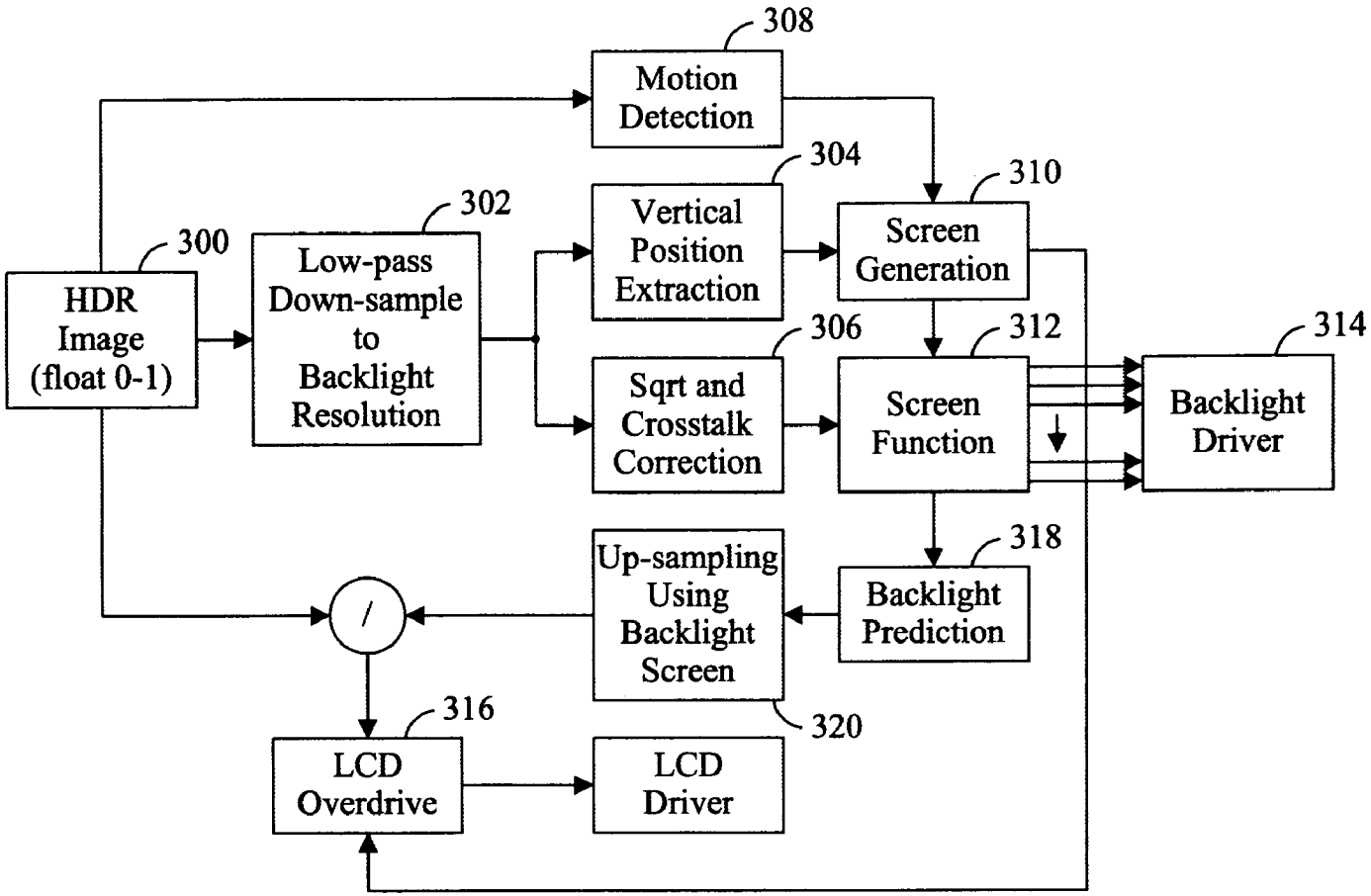
FIG. 10 illustrates an overdrive system.

FIG. 10 illustrates an exemplary flow diagram to convert high dynamic range video to be displayed on a high dynamic range display, consisting of a low resolution backlight and higher resolution LCD. Each HDR image 300 is low-pass filtered 302 and then sub-sampled to the backlight resolution. The vertical position 304 may be extracted and crosstalk correction 306 performed. The backlight resolution is determined by the number of backlight units, e.g. the number of LEDs in the backlight. Each pixel in the low resolution backlight image corresponds to a block in the HDR image.

For each backlight block, motion detection 308 is performed to determine whether it is a motion block or still block. For motion detection purpose, each backlight block may be subdivided into sub-blocks. In the preferred embodiment, each sub-block consists of 8×8 pixels in the high resolution HDR image. The process of motion detection may be as follows:

For each frame, 1. calculate the average of each sub-block in the HDR image for the current frame,
2. if the difference between the average in this frame and the sub-block average of the previous frame is greater than a threshold (in this case 5% of total range), then backlight block that contains the sub-block is a motion block. Thus a first motion map is formed
3. Perform a morphological dilation operation on the motion map (change the still blocks neighboring to a motion block to motion block) to form a second motion map.
4. perform a logical or operation of the second motion map with the second motion map of previous frame to form a third motion map.
5. for each backlight block,

```
if it is motion block,
   screen(i,j)=max(N+1,screen(i,j)+1);
else (still block)
   screen(i,j)=min(0,screen(i,j)−1);
```

The screen generation 310 is based upon the motion detection 308 and the vertical position extraction 304. A screen function 312 may be selected based upon the corrected image 306 and the screen generation 310. The backlight driver 314 receives the output of the screen function 312 to determine which backlight to illuminate and the level of illumination of the backlight(s). The screen generation 310 may provide an input to a LCD overdrive 316 which in combination with a backlight prediction 318 and an up-sampling 320 provides overdrive data to the HDR image 300.

In essence the technique described with reference to FIG. 10, includes the determination of motion for a region of the display. Since the light from the display tends to scatter somewhat, it is desirable to define the motion region larger than the region identified as including sufficient motion. In this manner, this additional region likely to exhibit light scattering will be provided with a suitable screen function so as to reduce the effects of blurring.

Figure 11:
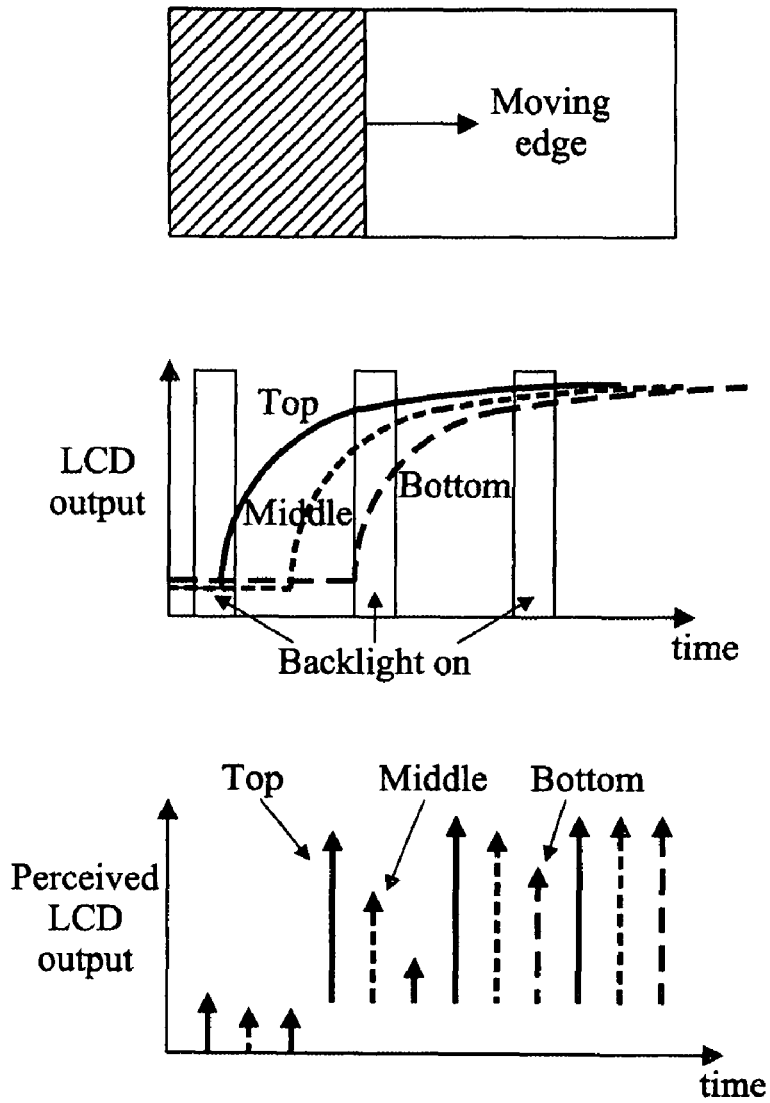
FIG. 11 illustrates ghosting due to synchronization.

Another type of ghosting is due to a timing difference between the LCD row driving and the backlight flashing. The LCD is driving from top to bottom, one line at a time. The bottom row is driven near one frame time later than the top row. FIG. 11 shows a moving edge and the LCD temporal response at three locations: top, middle, and bottom. Assuming backlight flashes at the end of the frame for the top row, the top row has a longest time for LCD to reach target level, while the bottom row has a shortest time, which is not enough to drive the LCD to the target level. A vertical edge can be seen to have different brightness from top to bottom. This brightness variation couples with the discrete backlight flashing causes ghost edges as shown in FIG. 11. (right).

Figure 12:
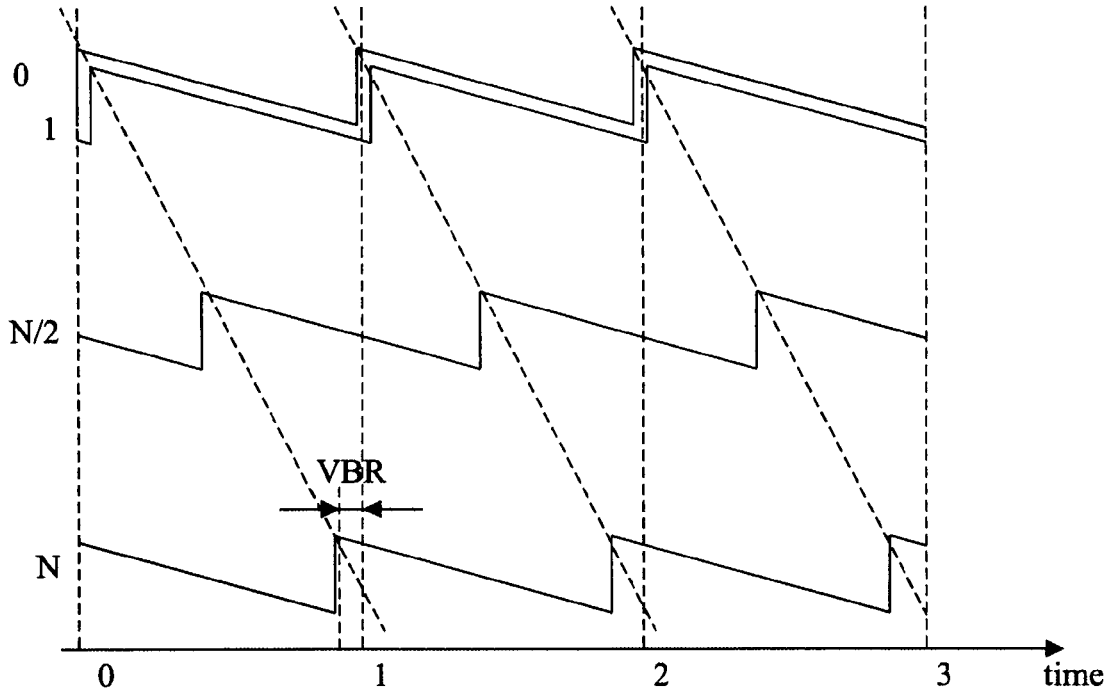
FIG. 12 illustrates shifted synchronization.

In the preferred embodiment, the screen as shown in FIG. 7 is shifted in time to compensate the LCD driving timing difference. The vertical position of each backlight pixel is extracted and it is combined with the motion detection output to generate a screen (see FIG. 9). FIG. 12 shows the timing of cluster screen as a function of vertical position. The screen is shifted according to the LCD driving. For still image block using disperse screen, shifting is not needed, because it won't result in substantial artifacts.

Figure 9:
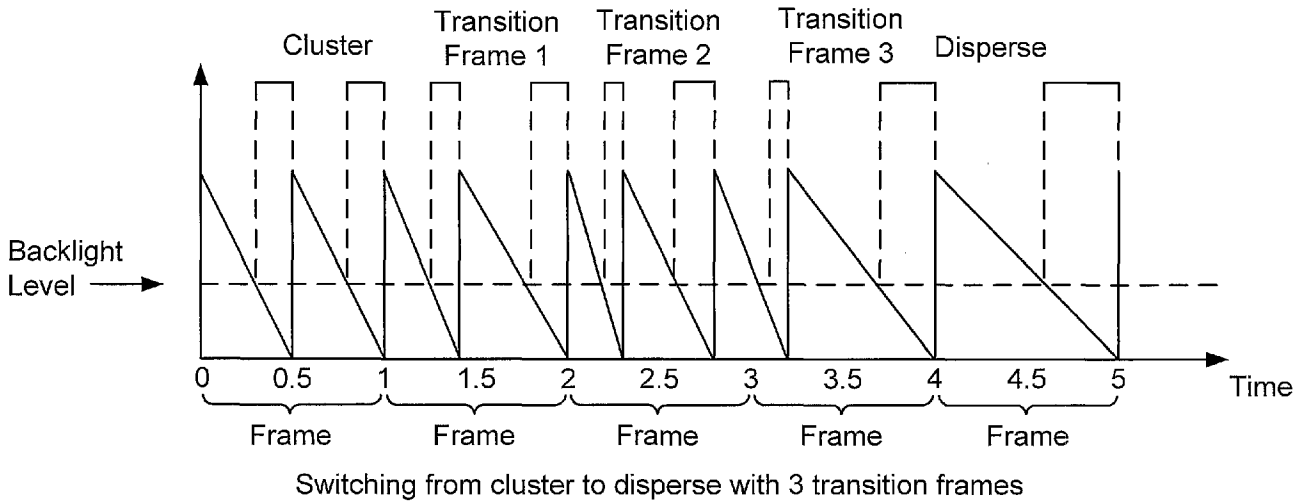
FIG. 9 illustrates transition from one temporal screen to another temporal screen.

In reference to FIG. 9, the backlight value can be derived from the down-sampled backlight image. One way is to take square root of the backlight image. Since the light from a backlight unit (LED) can spread to its neighboring blocks, crosstalk correction is used to compensate this spread. The corrected backlight value is compared to the screen as shown in FIGS. 6 and 7 to temporally modulate the backlight to achieve the desired output.

The actual backlight image that illuminates the LCD can be predict by convolving the backlight signal with the point spread function (PSF) of the backlight and it is up-sampled to the same resolution as the HDR image. The LCD transmittance that may be used to render the HDR image can be determined by $$T_{LCD}(x,y)=HDR(x,y)/bl(x,y)$$

where the bl(x,y) is the predicted backlight image. Next, gamma correction may be performed to convert LCD transmittance ($T_{LCD}$) into LCD driving digital counts.

For most LCD technology, overdrive is used to speed up the temporal transitions as shown in FIG. 9. In the preferred embodiment, an adaptive recursive overdrive (AROD) that can compensate for the timing of backlight. The AROD may be a modified recursive overdrive (ROD) algorithm that adapts to the screen. In some cases, where HDR is not desired, the backlight may be set to a uniform level, and the LEDimage is the same as the input image. If the temporal screen indicates that it is a still block (non-motion thus using dispersed screen), there is no need for overdrive. For the motion blocks, a cluster screen is used and overdrive is used as shown in FIG. 11. For each pixel, the current digital count ($x_n$) and the predicted LCD output level in the frame buffer are input to the overdrive circuit, where a new drive value ($z_n$) is derived based on a set of overdrive lookup tables. The new drive value is sent to the display prediction circuit and stored in the frame buffer for use in the next frame.

If the "on" time is larger, a larger overdrive value is used. Dynamic gamma is derived using the timing and width of the backlight and overdrive table is derived from the dynamic gamma data.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A method for displaying an image having a first resolution on a liquid crystal display having a second resolution less than said first resolution, said liquid crystal display including a backlight that illuminates an array of at least one light valve, said array having a first surface illuminated by said backlight and a second surface parallel to said first surface, and from which transmitted light emanates away from said array based on respective transmittance states of respective light valves in said array, said backlight comprising a plurality of backlight regions, each backlight region capable of achieving a selected one of a plurality of illumination levels, independent of the respective illumination levels produced by other ones of said plurality of backlight regions, said method comprising:

(a) receiving an image signal representative of at least one frame of said image;

(b) processing said signal by dividing said at least one frame into a plurality of image blocks each associated with a respective one of said plurality of backlight regions, and providing light at a first said illumination level to impinge upon said first surface from a first region of said backlight based upon a first determination that an image block associated with said first region is likely to include motion greater than a threshold, said first determination being made from a motion map constructed based upon said image blocks;

(c) providing light at a second said illumination level to impinge upon said first surface from a second region of said backlight based upon a determination that an image block associated with said second region is not likely to include motion greater than a threshold, said second determination being made from said motion map; where (d) said first and second illumination levels are each provided over a respective temporal flashing period divided between a first interval when a backlight from a respectively associated said region is on and a second interval when a backlight from a respectively associated said region is off, said first and second intervals calculated based on comparison of the provided illumination level to a screen function having the form: $S(t)=A(1-n*t+floor(n*t))$ where t is a continuous float variable of time expressed in frames, A is the backlight screen amplitude, n is an integer value, and floor(t) is an operation that takes the integer portion of its argument.

2. The method of claim 1 where more than one said image block is associated with a single one of said plurality of backlight regions.

3. The method of claim 2 where said motion map is constructed by:

(a) determining, for each said image block, the difference between the average luminance of said image block during two consecutive frames; and (b) comparing said difference to a luminance threshold.

4. The method of claim 3 where said luminance threshold is 5% of the total range of luminance of said backlight.

5. The method of claim 1 including the step of performing a logical "or" operation on respective modified motion maps of two consecutive frames.

6. The method of claim 1 where n is 1.

7. The method of claim 1 where n is 2.

8. The method of claim 1 where the value of n for a first region is different than that for a second region.

9. The method of claim 8 where n is selected for a region based on the motion for said region indicated by said motion map.

10. The method of claim 8 where n has a first value for a region during a first frame and a second value for a region during a second frame.

11. The method of claim 10 where said first and second levels are calculated for at least one transition frame, between said first frame and said second frame, based upon $$S_t=A[1-(t-\text{floor}(t))/0.5(1+(i/(N+1)))] \text{ for } 0<=t-\text{floor}(t)<0.5[1-i/(N+1)]$$

and $$S_t=A[1-(t-0.5-\text{floor}(t-0.5))/0.5(1+(i/(N+1)))] \text{ for } 0.5[1-i/(N+1)]<=t-\text{floor}(t)<1$$

where N is the total number of transition frames and i is the $i^{th}$ transition frame.

12. A method for displaying an image having a first resolution on a liquid crystal display having a second resolution less than said first resolution, said liquid crystal display including a backlight that illuminates at least one light valve, said backlight comprising a plurality of backlight regions, each backlight region capable of achieving a selected one of a plurality of illumination levels, independent of the respective illumination levels produced by other ones of said plurality of backlight regions, said method comprising:

(a) receiving an image signal representative of at least one frame of said image and analyzing said signal to determine respective amounts of motion in areas of said image, each area associated with each said plurality of backlight regions; and (b) providing light to a first pixel of said light valve having an illumination characteristic within a respective frame interval that is different from that of another pixel of said display during said respective frame interval, said respective frame interval divided between a first period when the said first pixel and said another pixel are each illuminated by respectively different ones of said plurality of backlight regions and a second period when the said first pixel and said another pixel are respectively not illuminated, said illumination characteristic selected based on the respectively determined amount of motion in the respective area associated with said backlight region illuminating said first pixel, where said first period and said second period have respective durations determined based on comparing the selected illumination level for said associated backlight region to a screen function having the form $S(t)=A(1-c_1*t+c_2*floor(t-c_3)-c_4)$, where t is a continuous float variable of time expressed in frames, A is the backlight screen amplitude, $c_1$ $c_2$, $c_3$, and $c_4$ are constants, and $floor(t-c_3)$ is an operation that takes the integer portion of its argument.

13. The method of claim 12 where n is 1.

14. The method of claim 12 where n is 2.

15. The method of claim 12 where the value of n for a first region is different than that for a second region.

16. The method of claim 12 where n is selected for a region based on the motion determined for said region.

17. The method of claim 12 where n has a first value for a region during a first frame and a second value for a region during a second frame.

18. The method of claim 17 where said first and second levels are calculated for at least one transition frame, between said first frame and said second frame, based upon $$S_t=A[1-(t-\text{floor}(t))/0.5(1+(i/(N+1)))] \text{ for } 0<=t-\text{floor}(t)<0.5[1-i/(N+1)]$$

and $$S_t=A[1-(t-0.5-\text{floor}(t-0.5))/0.5(1+(i/(N+1)))] \text{ for } 0.5[1-i/(N+1)]<=t-\text{floor}(t)<1$$

where N is the total number of transition frames and i is the $i^{th}$ transition frame.

19. The method of claim 18 where overdrive is used to accelerate the transition between said first frame and said second frame.

* * * * *

UNITED STATES PATENT AND TRADEMARK OFFICE

CERTIFICATE OF CORRECTION

PATENT NO. : 8,115,728 B2
APPLICATION NO. : 11/157231
DATED : February 14, 2012
INVENTOR(S) : Xiao-fan Feng It is certified that error appears in the above-identified patent and that said Letters Patent is hereby corrected as shown below:

In the Specifications:

Col. 7, Line 56

Change $$S_i = \begin{cases} A\left(1 - \dfrac{t - floor(t)}{0.5\left(1 - \frac{i}{N+1}\right)}\right) & 0 <= t - floor(t) < 0.5\left(1 - \dfrac{i}{N+1}\right) \\ A\left(1 - \dfrac{t - 0.5 - floor(t - 0.5)}{0.5\left(1 + \frac{i}{N+1}\right)}\right) & 0.5\left(1 - \dfrac{i}{N+1}\right) <= t - floor(t) < 1 \end{cases}$$

to read $$S_i = \begin{cases} A\left(1 - \dfrac{t - floor(t)}{0.5\left(1 - \frac{i}{N+1}\right)}\right) & 0 <= t - floor(t) < 0.5\left(1 - \dfrac{i}{N+1}\right) \\ A\left(1 - \dfrac{t - 0.5 - floor(t - 0.5)}{0.5\left(1 + \frac{i}{N+1}\right)}\right) & 0.5\left(1 - \dfrac{i}{N+1}\right) <= t - floor(t) < 1 \end{cases}$$

Signed and Sealed this
Twenty-third Day of April, 2013

Teresa Stanek Rea
*Acting Director of the United States Patent and Trademark Office*